US010112795B2

(12) United States Patent
Dettori et al.

(10) Patent No.: US 10,112,795 B2
(45) Date of Patent: Oct. 30, 2018

(54) DEVICE FOR CLOSING THE TAIL END OF A ROLL OF WEB MATERIAL, AND METHOD

(71) Applicant: UNIVERSAL TISSUE TECHNOLOGY S.R.L., Lucca (IT)

(72) Inventors: Daniele Dettori, Lucca (IT); Gionata Pardini, Lucca (IT)

(73) Assignee: MTORRES TISSUE S.R.L. (IT)

( * ) Notice: Subject to any disclaimer, the term of this patent is extended or adjusted under 35 U.S.C. 154(b) by 273 days.

(21) Appl. No.: 15/115,333

(22) PCT Filed: Jan. 27, 2015

(86) PCT No.: PCT/EP2015/051631
§ 371 (c)(1),
(2) Date: Jul. 29, 2016

(87) PCT Pub. No.: WO2015/113978
PCT Pub. Date: Aug. 6, 2015

(65) Prior Publication Data

US 2017/0210585 A1 Jul. 27, 2017

(30) Foreign Application Priority Data

Jan. 29, 2014 (IT) ..... FI2014A0016

(51) Int. Cl.
*B65H 19/29* (2006.01)
*B65H 19/22* (2006.01)

(52) U.S. Cl.
CPC ..... *B65H 19/29* (2013.01); *B65H 19/2246* (2013.01); *B65H 2301/414421* (2013.01);
(Continued)

(58) Field of Classification Search
CPC ..... B65H 19/29; B65H 19/2246; B65H 2301/414446; B65H 2301/414421; B65H 2301/414436
See application file for complete search history.

(56) References Cited

U.S. PATENT DOCUMENTS 3,393,105 A 7/1968 Tellier, Jr.
3,696,777 A 10/1972 Preen
(Continued)

FOREIGN PATENT DOCUMENTS

EP 0541496 5/1993

OTHER PUBLICATIONS

International Search Report dated May 8, 2015 by EPO/ISA, International Application No. PCT/EP2015/051631, 3 pages.

*Primary Examiner* — William E Dondero
(74) *Attorney, Agent, or Firm* — Ware, Fressola, Maguire & Barber LLP

(57) ABSTRACT

A feeding path (P) is provided for rolls (R, R1) to be closed and a closing station placed along that path. Two rollers (15, 17) form a cradle (19) for receiving the rolls (R, R1). A closing member (21) is provided to close a tail end (L). A rotating assembly (23) rotates around an axis (A-A) transverse to the feeding path and has groups (27A, 27B, 27C) of arms (28A; 28B, 28C) arranged with respect to one another angularly displaced around the rotation axis of the rotating assembly (23). Each arm has a front part (29) to eject a roll (R, R1) from the cradle (19) and a back part (31) to prevent a subsequent roll entering the closing station until the ejection of a roll from the cradle (19). Rotation of assembly (23) causes closed roll ejection and allows a subsequent roll (R1) to enter and be closed.

20 Claims, 8 Drawing Sheets

(52) U.S. Cl.
CPC ..... *B65H 2301/414436* (2013.01); *B65H 2301/414446* (2013.01)

(56) References Cited

U.S. PATENT DOCUMENTS

| | | | |
|---|---|---|---|
| 3,912,571 | A | 10/1975 | Hartbauer |
| 5,643,398 | A | 7/1997 | Lamberg |
| 6,682,623 | B1 | 1/2004 | Biagiotti |

DEVICE FOR CLOSING THE TAIL END OF A ROLL OF WEB MATERIAL, AND METHOD

FIELD OF THE INVENTION

The present invention relates to the field of the rolls production of web material, in particular paper roll, such as tissue paper, or the like. More specifically, the invention relates to improvements to the machines and to the devices for closing the tail end of the rolls, for example coming from winding or rewinding machines.

PRIOR ART

In the field of the paper transformation, for example for the production of tissue paper articles in the form of rolls, such as toilet paper, paper towels and similar, the paper produced in large reels, so-called parent reels coming from the paper mill, is unwound and rewound in rolls of lesser diametrical dimension and of axial length corresponding to the width of the paper web unwound from the parent reel. The outer tail end of these rolls is closed, for example by gluing, so that it does not unwind during the subsequent transformation operations. These provide, for example, the cutting of each roll into individual small rolls assigned to the packaging and to the distribution.

In WO96/365 553 is described a device for the gluing the tail end or outer tail end of rolls of wound web material. This device provides a feeding path for gravity of the rolls, along which is arranged a pair of motorized rollers which define a cradle within which the individual rolls are fed in sequence. The tail end of each roll that is placed in the cradle defined by said rollers is opened, i.e. unwound, to allow the application of a glue, through which the tail end then adheres to the roll, rewinding the tail end on it. An arm swinging about an axis placed below the feeding path of the rolls is used to eject each roll from the cradle formed by the said rollers and to temporarily retain the subsequent roll, preventing the entering of the roll in the cradle until the complete ejection of the glued roll and until the return in position of the swinging arm. The operation of this known device is relatively slow, since there is the need to attend that the swinging arm has ejected the previous roll and has transferred it in a gluing station placed downstream of the pair of rollers, before to allow the entrance of a new roll in the cradle formed by the two adjacent rollers.

There is therefore the need to provide a closing device of the tail end of rolls of web material which is simple and reliable, and at the same time efficient also in productivity terms.

SUMMARY OF THE INVENTION

According to one aspect, the invention provides a device for closing a tail end of roll of web material, comprising a feeding path of the rolls to be closed and, along the feeding path, a closing station. In the closing station of the tail end are provided two rollers forming a cradle for receiving the rolls and a closing member of the tail end. Advantageously, the device can comprise an assembly rotating about an axis transverse to the feeding path of the rolls and comprising groups of arms arranged with respect to one another angularly displaced around a rotation axis of the rotating assembly. The rotation axis of the rotating assembly is suitably placed above the feeding path of the rolls and the rotating assembly is advantageously controlled so as to always rotate in the same direction.

Each arm comprises a front part configured to eject a roll from the cradle and a back part configured to hold a subsequent roll along the feeding path, preventing its entrance into the closing station until the ejection of the roll from said cradle, the rotation of a step of said rotating assembly causing the ejection of a closed roll from the cradle and allowing the entrance in said cradle of a next roll to be closed.

Upstream of the rotating assembly can be arranged a dispenser, for example, a rotating dispenser or of any other type, which allows the making of an accumulation of the roll and the dispenser of a roll at a time towards the rotating assembly.

This configuration, extremely simple, allows to control in efficient and reliable way the consecutive entering of rolls in the closing station through control of their advancement along the path, thanks to the rolls rest on the back part of the rotating arms. With the assembly rotation each roll is rolled, preferably by gravity, along the path, until to stop in the cradle. The rotation of the rotating assembly can continue until the next group of arms is placed in a position to stop the subsequent rolls upstream of the cradle of the closing station, holding them in such waiting position until the completion of one or more closing operations of the tail end, which are preformed in the closing station of the tail end. After that, the rotating assembly is put in rotation, in the same direction, so that the group of arms which was temporarily placed upstream of the closing station pushes with the front part of the arms the first roll ejecting it from the closing station, while causes the controlled feeding of the subsequent roll in the cradle.

Contrary to other known gluing, in which the rolls are ejected by an assembly provided with a reciprocating motion, as described for example in the patent documentation mentioned in the introductory part, in a gluer according to the invention the rotating assembly carries out, for each step of rotation of the rotating assembly, an eject operation of a roll from the cradle of the gluing station and simultaneously a controlled feeding operation of a new roll in the station itself. This greatly increases the productivity of the gluer.

The closing station can include gluing members, for example a glue applicator with a nozzle or more nozzles, a bar, a blade, a wire or other applicator member. In other embodiments, the closing of the tail end for example can be done with mechanical pressure. In some embodiments, the application of the glue can occur when the roll is ejected from the cradle, rolling it on a glue applicator, everything according to technologies per se known to skilled in the art.

In advantageous embodiments the arms have a thrusting surface configured to push out a roll from said cradle, on the anterior part or on the front part, i.e. oriented forward with respect to the direction of rotation of the rotating assembly. Each arm can further comprise a rest surface, for receiving in support a roll and hold it in said path upstream of said cradle. The rest surface is oriented backwards with respect to the direction of rotation of the arm.

As will become apparent from the following description of same embodiments, a device according to the present invention can be configured so that not requires particular mechanical adaptations in case of change of diametrical dimensions of the rolls.

According to a further aspect, the invention provides a method for closing the tail end of a web material wound in a roll, comprising the steps of:

arranging a feeding path of the rolls to be closed;

arranging a closing station of the tail end of the rolls along the feeding path, said closing station comprising two rollers, which form a cradle for receiving the rolls, and a closing member of the tail end;

arranging an assembly rotating about an rotation axis transversal to the feeding path of the rolls and comprising groups of arms arranged with respect to one another angularly offset displaced around said rotation axis of the rotating assembly, each arm comprising a front part and a back part respect to the direction of rotation;

controlling the feeding of a first roll, advantageously a feeding through rolling by gravity, along the feeding path, resting the first roll at the back part of a first group of said arms;

stopping the first roll in the cradle in a position in which a second set of arms is placed upstream of the cradle and prevents the entering of further rolls in the cradle;

feeding a second roll along said path up to supporting the second roll to the back part of the second group of arms;

performing an operation for the closing of the tail end of the first roll;

rotating the assembly so as to eject the first roll from the cradle by pushing it with the front part of the arms of the second group and so as to advance the second roll in support of the back part of the arms of the second group until it stops in the cradle.

The operation for the closing of the tail end can also be a simple operation of angular positioning and/or of opening of the tail end, while the real closing operation, for example by applying of a glue and rewinding of the tail end of the roll, can take place while the roll is ejected from the cradle. In other embodiments, the application of the glue can take place while the roll is placed in the cradle. The rewinding operation can occur when the roll is still in the cradle, for example by rotating it by the rollers defining the cradle, or ejecting the roll from the cradle and rolling it in the winding direction.

Distinctive embodiments are described below and further defined in the enclosed claims, which form an integral part of the present description. The above brief description identifies characteristics of varies embodiments of the present invention so that the detailed following description can be better understood and in order that the contributions to the art can be better appreciated. There are, of course, other features of the invention that will be described in the following and that will be explain in the enclosures claims. With reference to this, before showing various embodiments of the invention in detail, it should be understood that the various embodiments of the invention are not limited in their application to the structural details and to the dispositions of components described in the following description or illustrated in the drawings. The invention can be implemented in other embodiments and carried out and placed into practice in various ways. Furthermore, it should be understood that the phraseology and terminology employed herein are only for descriptive purposes and can not to be considered limiting.

The skilled of the art will understand, therefore, that the concept on which is based the description can be readily utilized as a basis for designing other structures, other methods and/or other systems to carry out the various purposes of the present invention. It's important, therefore, that the claims are considered comprehensive of those equivalent constructions which do not depart from the spirit and scope of this invention.

BRIEF DESCRIPTION OF THE DRAWINGS

The invention will be better understood following the description and the enclosed drawing, which shows a practical embodiment of the device according to the invention. More particularly, in the drawing.

DETAILED DESCRIPTION OF EMBODIMENTS

Figure 1:
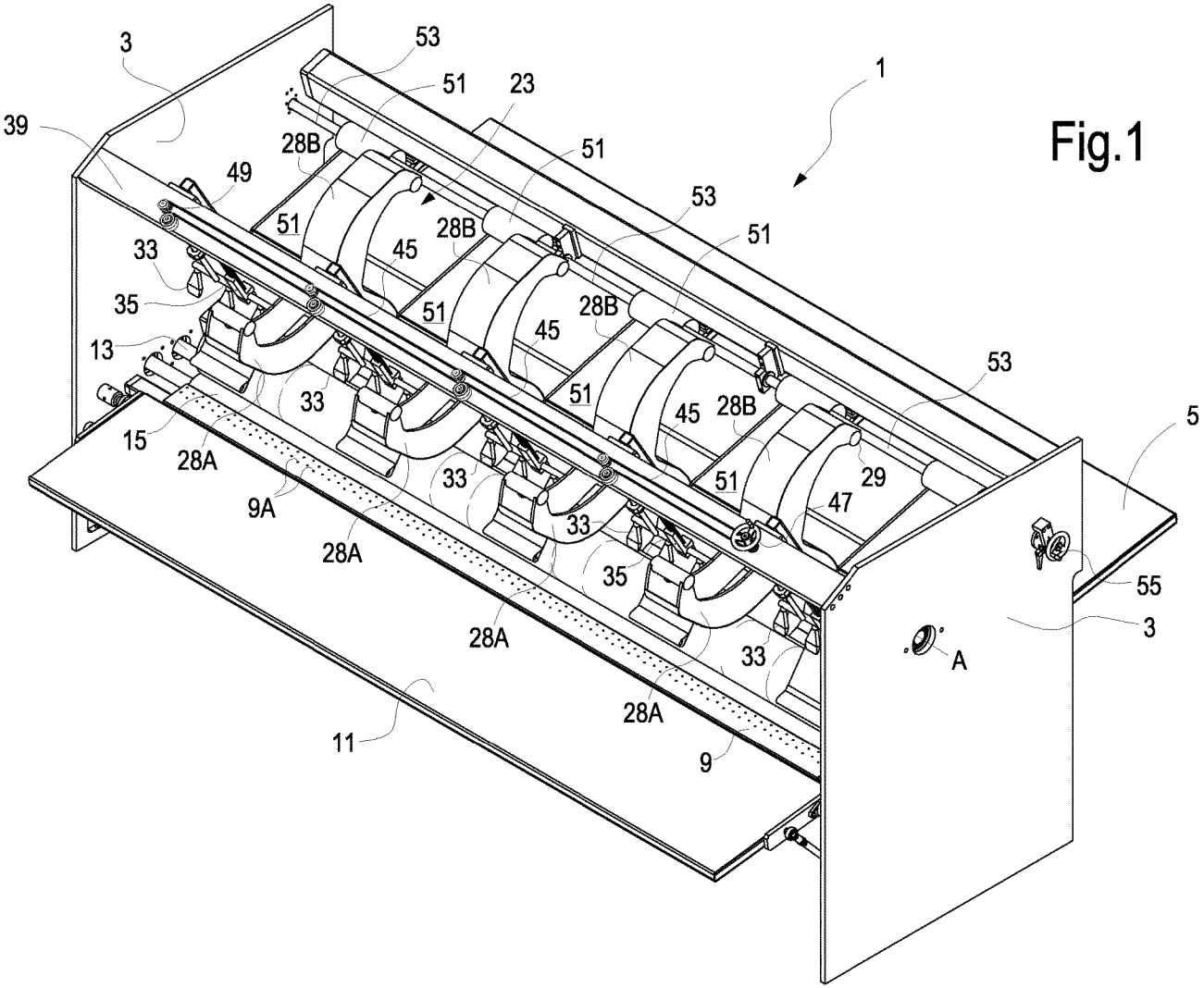
FIG. 1 illustrates an axonometric view of a device according to the invention in a first embodiment.
Figure 2:
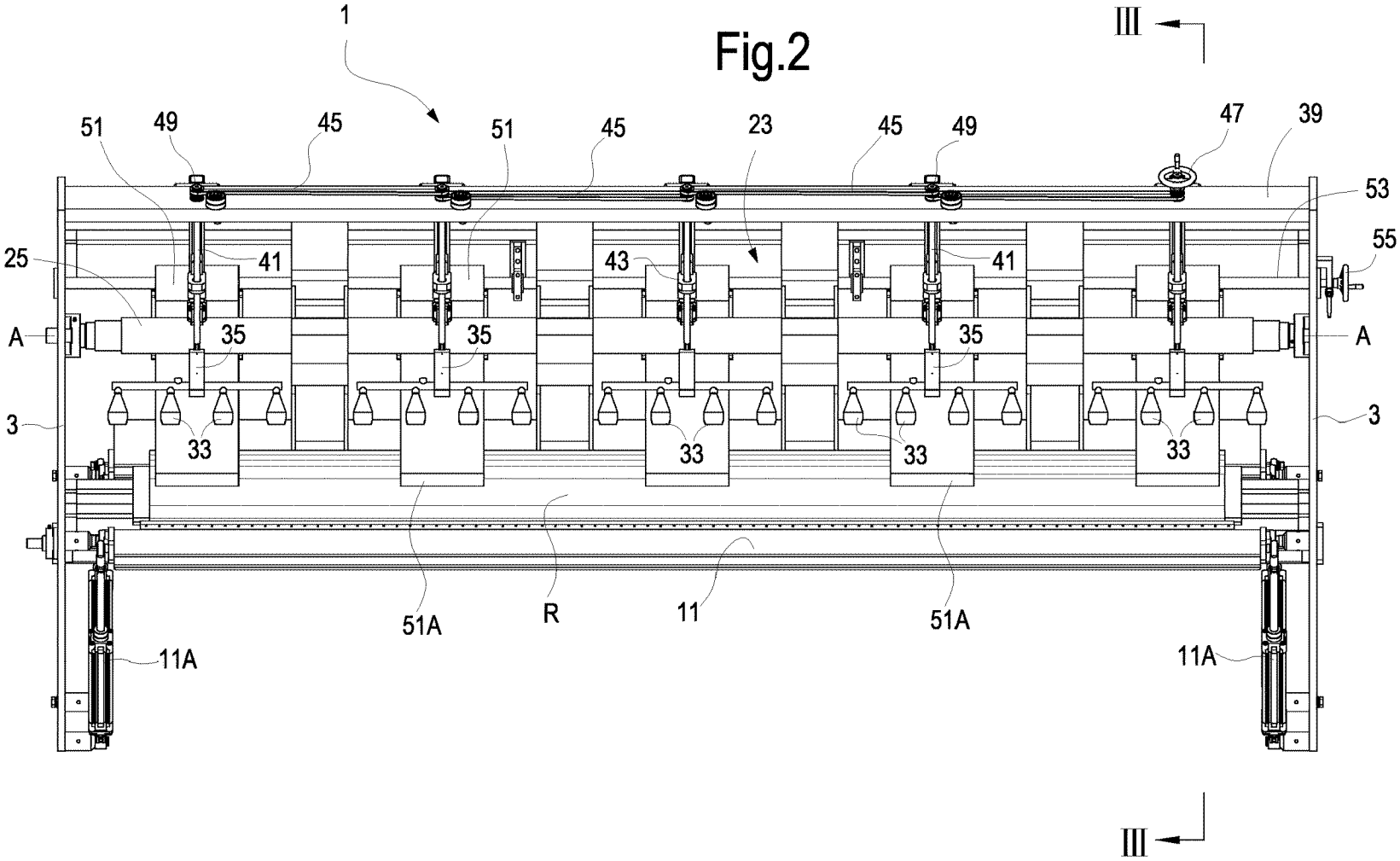
FIG. 2 shows a front view of the device of FIG. 1.

The following detailed description of illustrative embodiments refers to the accompanying drawings. The same reference numbers in different drawings identify the same or similar elements. Moreover, the drawings are not necessarily to scale. Furthermore, the following detailed description does not limit the invention. Rather, the object of the invention is defined by the accompanying claims.

The reference in all the description to "an embodiment" or "the embodiment" or "some embodiments" means that a particular feature, structure or element described in relation to an embodiment is comprised in at least one embodiment of the object described. Therefore, the phrase "in one embodiment" or "in the embodiment" or "in some embodiments" in various points along the description not refers necessarily to the same embodiment or to the same embodiments. Moreover, the particular characteristics, structures or elements can be combined in any suitable manner in one or more embodiments.

With reference to the embodiment illustrated in the accompanying FIGS. 1 to 4, the device, indicated as a whole with 1, can comprise two lateral sides 3, between which develops a feeding path of rolls R to be closed. As it is easily understood from FIGS. 3A-3C, the feeding path, indicated with the arrow P, is descending, so that the rolls R feed by gravity along at least a part of the path.

In some embodiments, the feeding path of the rolls R is defined by planes or rolling surfaces arranged in sequence. For example, along the path P can be arranged a first input surface 5, a second intermediate surface 7, a third suction surface 9 for the object hereinafter described, accompanied by a series of openings 9A and of an underlying suction box 9B, and an output surface 11.

Advantageously, the surfaces 5 and 11 can be mobile according to the double arrow f5 and f11 for opening a passage upstream and downstream of the device 1, for example for maintenance reasons. Actuators, such a pneumatic actuators 5A or piston-cylinder hydraulic actuators 11A, can be provided to control the lifting and lowering movement of the surfaces or of the rolling planes 5 and 11.

Along the feeding path P can be arranged a closing station, for example for gluing, of the tail end of the rolls. The closing station, hereinafter also indicated as gluing station, is altogether indicated with 13, see in particular FIGS. 3A-3C. In advantageous embodiments the gluing station 13 comprises a pair of rollers 15, 17 arranged side by side with respect to one another and with the axes substantially parallel, transversely oriented compared to the feeding path P. The rollers 15, 17 define a cradle 19 arranged along the feeding path of the rolls R in the path P.

The gluing station 13 has a gluing system, which provides a glue dispenser able to apply a glue to the web material that forms each roll R. The gluing can be made by applying the glue on the surface of the roll or on the surface of the tail end of it which is carried out in the manner described below in the gluing station 13.

Figure 3A:
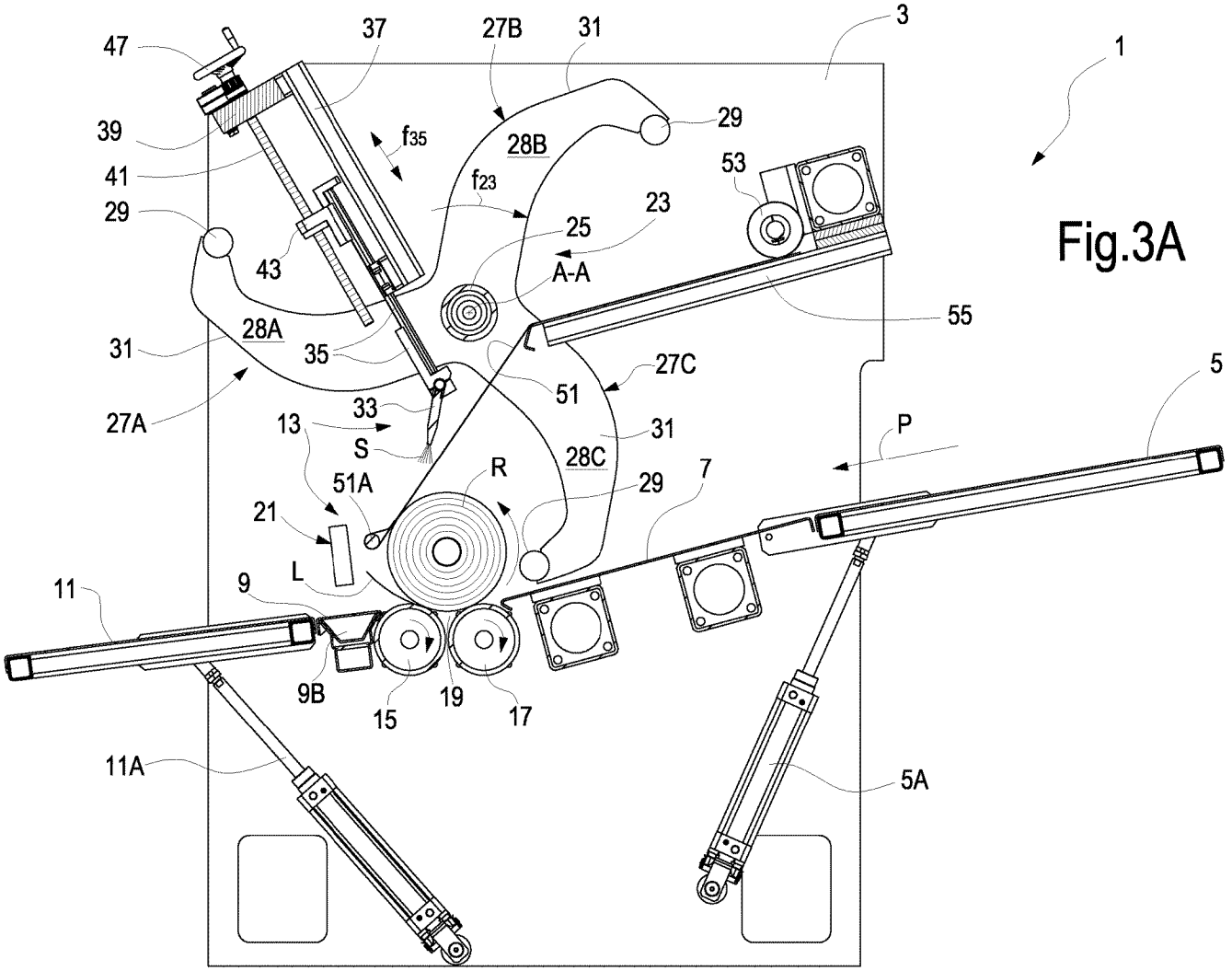
FIGS. 3A, 3B and 3C show sections along line III-III of FIG. 2 of the device in three different steps of operation.
Figure 3B:
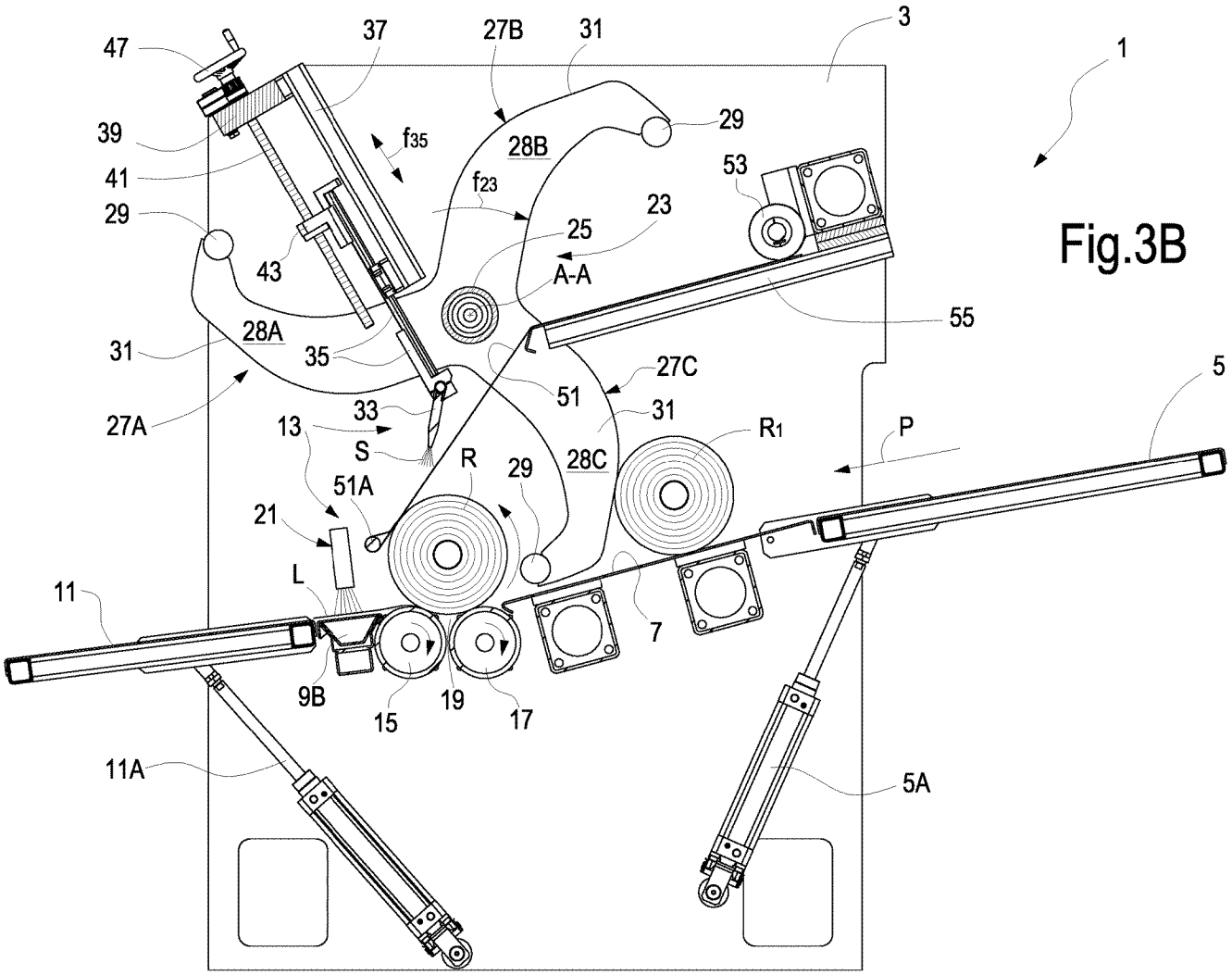
Figure 3C:
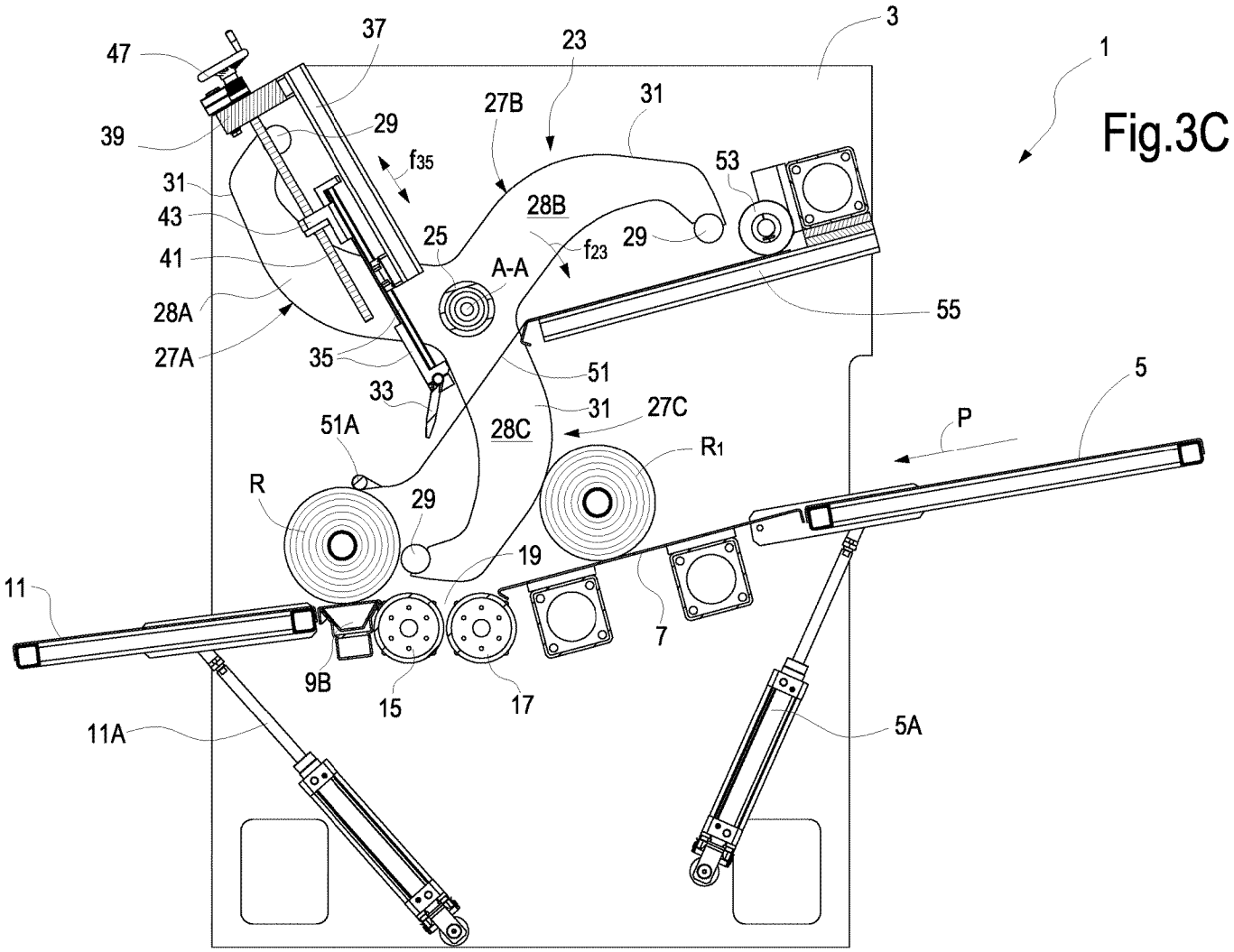

By way of example, in the accompanying figures the glue dispenser is represented in the form of a nozzle 21, schematically represented in FIGS. 3*a*, 3*b* and 3*c* but omitted for clarity of drawing in the remaining figures. The nozzle 21 can be controlled to move transversely with respect to the feeding path P and parallel to the axes of the rollers 15, 17. In this embodiment, the nozzle 21 is placed above the suction surface 9, so as to apply a glue on the tail end of the roll R which is in the gluing station 13, which tail end is unrolled and lying on the suction surface 9. In other embodiments can be provided two or more transversely movable nozzles, rather than a single nozzle. Each nozzle must do a shortest path to glue the tail end, so that gluing is faster.

In other embodiments, the glue dispenser can have a different form. For example can be provided a blade, a wire or a bar, which applies a glue line on the tail end or on the cylindrical side surface of the roll, preferably, in an area which will subsequently be covered by the done tail end, when it will be again wound on the roll. In other embodiments the glue can be dispensed through a slot or opening on which the roll is rolled once the tail end has been done by it.

In still further embodiments, the tail end can be fixed to the roll in some other way, for example by pressure, with a system of mechanical joining of cellulosic web forming the roll, provided in the closing station 13. In the description that follows the reference will be made to the presently preferred embodiment, which provides a closing by gluing.

Above the feeding path P of the rolls R is arranged a rotating assembly 23. The rotating assembly 23 comprises for example a shaft 25 rotating about a transversal axis A-A, which is substantially oriented at 90° with respect to the advancement direction R of the rolls along the feeding path P. The axis A-A is placed above the path P and it is preferably horizontal when the device is in the use position. The whole rotating assembly 23 can suitably be placed on the surfaces 5, 7, 9, 11 and on the cradle 19.

The rotating assembly 23 has three groups 27A, 27B and 37C of arms approximately radially developed from the shaft 25. Each group 27A, 27B and 27C of arms presents (see in particular FIGS. 1 and 2) a plurality of arms individually indicated with 28A for the arms of the group 27A, and with 28B for the arms of the group 27B and with 28C for the arms of the group 27C.

In the illustrated example, each group of arms comprises four arms in a generally radial development 28, but it should be understood that the number of arms of each group can vary depending on for example the transverse dimension of the device 1.

The arms 28A, 28B, 28C of each group 27A, 27B, 27C are arranged in the same angular position about the shaft 25, i.e. are aligned with each other, to simultaneously act on a roll. The groups of arms can be advantageously disturbed according to a constant angular pitch, i.e., with an equal angular offsetting. In the illustrated example this offsetting is equal to 120° being provided three groups 27A, 27B, 27C of arms 28. It is not excluded the possibility of using a different number of groups of arms arranged with an angular pitch different from that illustrated. Overall, therefore, the rotating assembly 23 may have a plurality of triads of arms 28A, 28B, 28C, in the illustrated example four triads, equidistant between them.

In advantageous embodiments, each arm 28A, 28B, 28C presents a thrusting front surface 29 of the rolls, for ejecting the rolls R from the gluing station 13, and more particularly from the cradle 19, after the application of the glue. Each arm 28A, 28B, 28C also presents a supporting back surface 31, which is able to hold the rolls coming from the surface 7 upstream of the gluing station 13, when a roll previously fed is placed in the cradle 19. In the shown embodiment the arms 28A, 28B, 28C have an arcuate shape, with a concavity facing forwards, and a convexity facing backwards respect to the direction of rotation of the rotating assembly 23, represented by the arrow f23.

In the gluing station 13 can be provided air blowing nozzles, indicated with 33. These nozzles have the function of generating puffs of air to re-open the tail end of the roll which is positioned in the cradle 19 defined by the rollers 15 and 17.

Advantageously, one or more nozzles 33 are placed between each side wall 3 and the first triad of arms 28A, 28B, 28C adjacent to the side, as well as between pairs of consecutive triad of 28A, 28B, 28C along the rotation axis A-A of the rotating assembly 23. In this way the nozzles 33 do not interfere with the rotatory movement of the rotating assembly 23.

In some embodiments the nozzles 33 are arranged in groups, so that between each pair of triad of adjacent arms 28A, 28B, 28C let alone between each side wall 33 and the adjacent triad of arms are placed more nozzles. In the illustrated embodiment are provided four nozzles in each position.

In some embodiments the nozzles 33 can have an adjustable distance respect to the feeding path P of rolls R, with the aim of better adapted themselves to the diametric dimension of the rolls. In some embodiments, for this object one or more nozzles in each position are carried by a respective slide 35 slidable along a guide 37 carried by a crossbar 39 which develops between the two sides wall 3. Each slide 35 can be engaged to a threaded bar 41, by means of a nut 43. The rotation of the threaded bar 41 causes in this way the movement according to the double arrow f35 of the respective slide 35 along the guide 37. The latter is inclined downwardly and therefore the moving according to f35 change the position of the nozzles 33 supported by the slide 35 with respect to the rolling surface of the rolls R.

The threaded bars 41 can be operated in various ways, for example each one with a self-contained actuator, for example an electric motor. In other embodiments, as shown in the figures, the simultaneous operation of the threaded bars 41 can be obtained via a series of toothed belts 45 (see in particular FIGS. 1 and 2), which take their motion from a single control member. In the illustrated example the control member can be manual, such as a hand-wheel 47. In other embodiments it can be provided a motor driving system which appears, for example by an electric motor. The various toothed belts 45 can be wound about respective toothed pulleys 49. In this way the rotation of the hand-wheel 47 causes a synchronous rotation of all the toothed pulleys 49 which, being mortised on the threaded bars 41, causing the synchronous adjustment of the position of all nozzles 33.

In some embodiments the device 1 comprises means for limiting the length of the tail end of each roll R which is unwound from the roll for laying it on the surface 9 and for performing the gluing. In the illustrated embodiment, for this object there are provided the flexible members 51, each of which is winded around a transversal shaft 53. The rotation of the transversal shaft 53 can be controlled by an actuator or, as in the example shown, via an adjustment hand-wheel 55, or other suitable member. The rotation of the transversal shaft 53 in one direction or in the other causes a partial simultaneous winding or unwinding of the various flexible members 51 that are placed between the individual triads of arms 28A, 28B, 28C as well as between the side walls 3 and the triads of arms 28A-28C adjacent to the side walls. In other embodiments it can be provided a different number of flexible members 51. Preferably the number of flexible members 51 is equal to the number of nozzles or to groups of blowing nozzles 33.

The tail end of the flexible members 51, indicated with 51A, it is arranged over the surfaces defining the feeding path P of the rolls R, i.e. above the cradle 19 and the rollers 15, 17 as well as above the surface 7 and its position is such that the rolls R which are advancing along the path P interfere with the flexible members 51. When a roll R advances to be arranged in the cradle 19, it comes in contact with the flexible members 51 causing the forward oscillation until to assume the position of FIG. 3A. This means that in the subsequent unwinding operation of the tail end of the roll R said final tail end is unwound for a limited length, defined by the distance between the contact point of the roll R with the roller 15 and the contact point of the roll R with the flexible members 51.

To avoid the interference between the arms 28A-28C of the rotating assembly 23 and the transversal shaft 53, the latter is arranged at a certain distance with respect to the trajectory of the arms and between the shaft 52 and the axis A-A of the rotating assembly 23 they are provided shelves 55 on which rest the flexible elements 51, the end of the shelves 55 being in advanced position along the feeding path P, in proximity of the gluing station 13.

The operation of the device described so far is the following.

In FIG. 3A a roll R has been placed in the gluing station 13 and it is placed in the cradle 19 in contact with the rollers 15 and 17. These are placed in rotation in the direction indicated by the arrows to rotate the roll R in the winding direction. The rotation of the roll R carries its tail end L beyond the contact point with the flexible members 51. It is opened by effect of air puffs S generated by the nozzles 33. The tail end L is pushed towards the suction surface 9 and held by the aspiration through suction passages or holes 9A (FIG. 1), of which the suction surface 9 is provided. The rotation movement of the rollers 15, 17 can be stopped when the terminal edge of the tail end L is in a position determined for example by an optical sensor (not shown).

When this position is reached, as shown in FIG. 3*b*, through the glue dispenser 21 the glue can be applied on the surface of the tail end L facing upward, while it is held on the suction surface 9.

During these operations, a second roll R1 fed from a station upstream of the device 1, for example, a rewinding machine, or an accumulation storehouse, or other, can get into the device 1. To prevent that the second roll R1 interfere with the gluing operations the tail end L of the roll R, the second roll R1 is stopped upstream of the gluing station 13 going to lean on the rear edge of the arms 28C of the group 27C of arms of which is equipped the rotating assembly 23, as shown in FIG. 3*b*.

Figure 4:
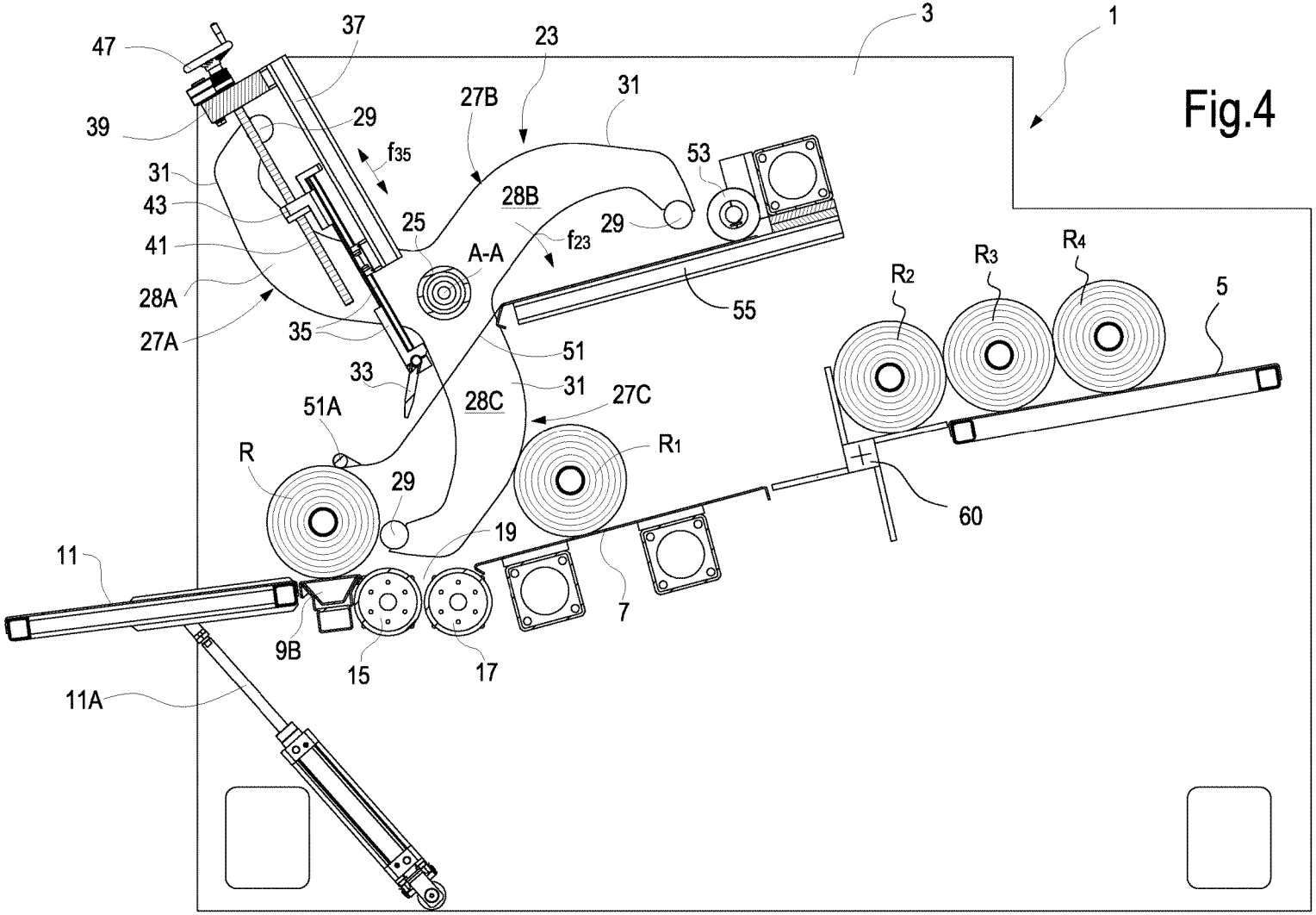
FIG. 4 shows a section similar to the sections of FIGS. 3A-3C of a further the embodiment of the device; the FIGS. 5A and 5B show a further embodiment of the device, in two different operating positions.

Any further rolls that arrive from the station upstream along the feeding path P can be temporarily stopped upstream of the action zone of the rotating assembly. For this object, in a suitable position, for example at the inlet of the device 1, can be placed a rotating dispenser, so configured as to feeding a single roll along the path toward the rotating assembly, holding the subsequent rolls. Rotating dispensers assigned to this object are described for example in U.S. Pat. No. 5,242,525 or EP581331, whose contents is incorporated in the present description. A configuration in which there is provided a rotating dispenser 60 integrated in the gluer 1 is shown in FIG. 4, where identical numbers indicate parts identical or corresponding to those of FIGS. 1-3C. The rotating dispenser 60 can be replaced with any other mechanism able to pass toward the rotating assembly 23, one roll at a time and to form an accumulation of rolls R3, R4, R5, etc. upstream of the dispenser itself.

Once the glue has been applied on the tail end L, the rollers 15, 17 in rotation to cause the rewinding of the tail end, and then its adhesion to the roll R.

After this operation, the rotating assembly 23 can be carried in rotation according to the arrow f23 as shown in FIG. 3C for causing from one side the ejection of the roll R from the cradle 19 and from the gluing station 13 and from the other to allow the input by controlled rolling of the next roll R1. The movement (arrow f23) of the rotating assembly 23 is controlled for example by a stepper-motor or the like (not shown) in order to accompany the advancement by rolling under the effect of gravity of the roll R1 preventing it exceeds the cradle 19, but ensuring that it moves forward until the entry in the same cradle and here arrest itself.

Contextually, through the thrusting surfaces 29 of the arms 28C cause the beginning of the rolling of the roll R just glued on the surface 9 and subsequently on the surface 11 to eject it from the gluing device 1.

The ejection operations of the roll R glued by the cradle 19 can also occur without prior rewind through the rollers 15, 17 the roll R, since the rolling caused by the thrust of the arms 28C, however, involves the rewinding of the tail end L on the roll R by effect of its rolling on the surface 9 and then on the surface 11.

The flexible members 51 lose contact with the roll R while this is ejected and are again arranged so as to interfere with the trajectory of the new roll R1 to be placed together with the roll R at the position of FIG. 3A and for starting a new cycle of gluing.

The foregoing description clarifies that when the diameter of the rolls R that must be glued changes, it is not necessary to make adjustments of the machine, possible being only necessary to adapt the length of the flexible members 51. This makes the gluer direction very simple.

Figure 5A:
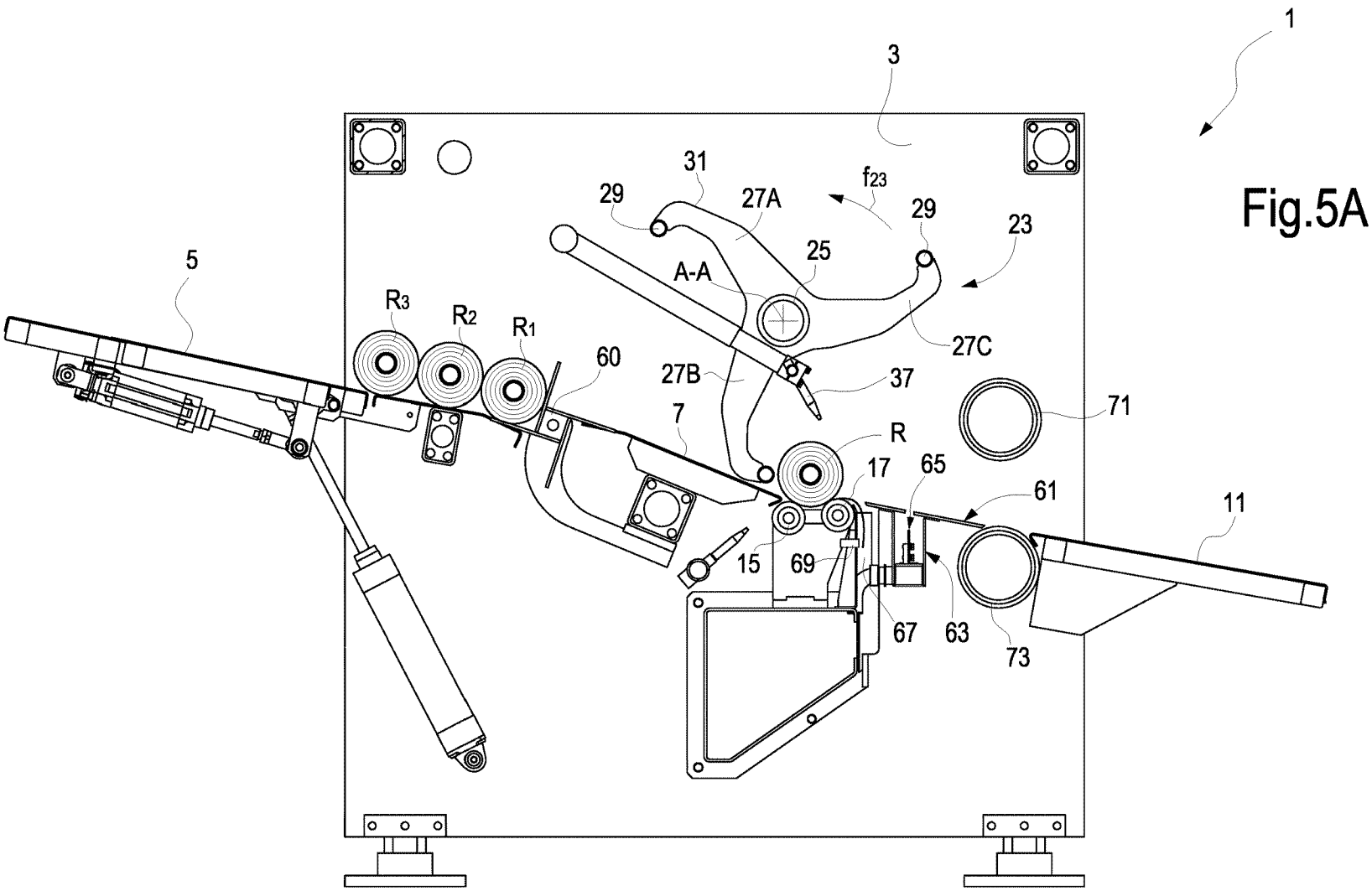
Figure 5B:
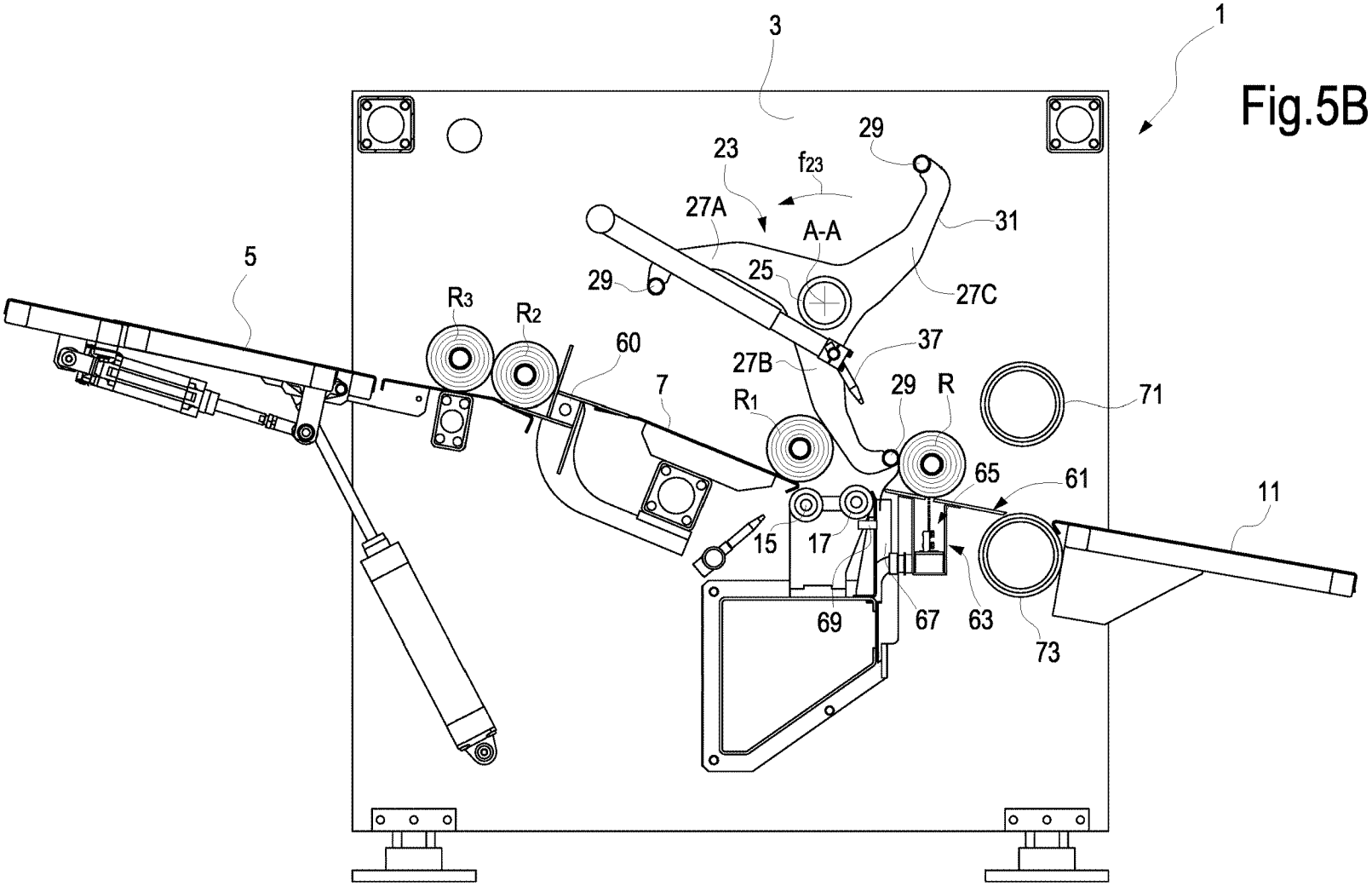

FIGS. 5A, 5B show two successive moments of a gluing process in a device according to a further embodiment. Identical numbers indicate parts identical or equivalent to those already described with reference to the previous FIGS. 1-4 and which will not be further described. The embodiment of FIGS. 5A, 5B differs from the previous ones because of a different glue applicator. In this case, in fact, in the closing station is provided a rolling surface 61 downstream of the cradle 15, 17 for receiving the rolls in the closing station. Along the rolling surface 61 is arranged a glue applicator which constitutes or forms part of a closing member of the tail end. The glue applicator is generally indicated with 63 and comprises a movable element 65, such as a wire, a bar or a blade, which picks up glue from a tank and carries it to the height of the rolling surface 61. When the roll ejected from the cradle 15, 17 rolls along the surface 61, the glue picked up by the movable element 65 is transferred onto the cylindrical surface of the roll.

The gluing can be completed due to the rolling along the surface 11. In other embodiments, along the path of the glued roll, for example downstream of the rolling surface 61, is placed a pair of rollers 71, 73 mutually overlapped, suitably driven at a controlled speed. The roll which has received the glue is wedged between the two rollers 71, 73. These rotate at the same peripheral speed for a certain time, during which the roll remains between the two rollers 71, 73 and rotates about its own axis. This causes the pressure of the tail end on the cylindrical surface of the roll and thus a stable gluing. After the roll has made a desired number of rotations around its own axis, by altering the peripheral speed of the rollers 71, 73, it is caused the ejection of the roll to the outlet surface 11.

For opening and placing the tail end before the ejection of the roll from the cradle 15, 17 can be provided a suction chamber 67 which is placed below the rolling surface 61. In the suction chamber 67 can be placed a photocell 69 which determines the position of the tail end required for a correct gluing. The signal of the photocell 69 or other equivalent sensor determines the stopping command of the rotation of the rollers 15, 17.

The gluing system of the closing station of the tail end in this case is arranged so that the closing takes place after the ejection of the roll from the cradle 15, 17 rather than while the roll is still in the cradle, with which is obtained a faster operation of the machine. The gluing system described above can be realized for example as described in more detail in U.S. Pat. No. 5,681,421, whose content is incorporated in the present description.

The invention claimed is:

1. A device for closing a tail end of a roll of web material comprising:

a feeding path of the roll to be closed;

a closing station along the feeding path of the roll for closing the tail end of the roll;

in the closing station of the tail end of the roll, two rollers forming a cradle for receiving the roll and a closing member for closing the tail end;

an assembly rotating around a rotating axis transverse with respect to the feeding path, and comprising groups of arms arranged with respect to one another angularly displaced around said rotation axis, each arm comprising a front part configured to eject the roll from the cradle and a back part, configured to hold subsequent rolls along the feeding path, thus preventing them from entering in the closing station until the roll has been ejected from said cradle, a one-step rotation of said rotating assembly causing ejection of the closed roll from the cradle and allowing one subsequent roll to be closed to enter said cradle.

2. The device according to claim 1, in which said closing member comprises a glue dispenser to apply glue on the roll or on the tail end thereof.

3. The device according to claim 1, in which the closing member is arranged and configured to close the tail end when the roll is placed in the cradle.

4. The device according to claim 1, in which the closing member is arranged and configured to close the tail end while or after the roll has been ejected from the cradle.

5. The device according to claim 1, in which said each arm has a thrusting surface configured to thrust the roll out of said cradle, and a rest surface to support the roll and hold it in said path upstream of said cradle, the rest surface being arranged behind the thrusting surface with respect to the direction of rotation of the rotating assembly.

6. The device according to claim 1, in which said each arm is curved and has a concave edge and a convex edge, the concave edge facing forwards and the convex edge facing backwards with respect to the direction of rotation of the rotating assembly.

7. The device according to claim 1, wherein the feeding path has a first rolling surface for the roll, arranged upstream of the rollers forming said cradle with respect to the roll feeding direction along said feeding path.

8. The device according to claim 1, comprising a second rolling surface for the rolls, arranged downstream of the rollers forming said cradle with respect to the roll feeding direction along said feeding path.

9. The device according to claim 1, wherein each group of arms comprises a plurality of arms that are arranged in a same angular position with respect to the rotation axis of said rotating assembly and they act simultaneously onto a roll arranged in said cradle, to eject it from the cradle, and onto a subsequent roll following in said feeding path to prevent it from entering said cradle.

10. The device according to claim 1, wherein air blowing nozzles are arranged in said closing station to open the tail end of a roll arranged in said cradle, and a surface for extending the unwound end.

11. The device according to claim 10, wherein associated with said nozzles there are adjusting members for regulating the position of the nozzles with respect to the cradle.

12. The device as claimed in claim 10, wherein the nozzles are carried by supports arranged between said arms, so that the nozzles do not interfere with the rotation of the arms of the rotating assembly.

13. The device according to claim 1, comprising adjusting members for regulating a length of the end unwound from the roll in the closing station.

14. The device according to claim 13, wherein said adjusting members for regulating the length of the unwound end comprise flexible members with a free end, interposed between trajectories of the arms of the rotating assembly and interfering with the roll feeding path, said flexible members being arranged and configured so as to rest on a side cylindrical surface of the roll positioning in said cradle, so that the roll free end is unwound by an entity defined by the point of contact of the flexible members onto the side cylindrical surface of the roll.

15. The device as claimed in claim 14, wherein said flexible members have adjustable length, adjusting members being provided for adjusting the length of the flexible members and a distance of ends thereof from a rolling surface for the roll along the feeding path.

16. A method for closing the tail end of a roll of web material, comprising:

providing a feeding path for the roll to be closed;

providing, along the feeding path, a closing station for closing the tail end of the roll, said closing station comprising two rollers forming a cradle for the roll, and a closing member for closing the tail end;

providing an assembly rotating around a rotation axis transverse with respect to the roll feeding path and comprising groups of arms arranged with respect to one another angularly displaced around said rotation axis of the rotating assembly, each arm comprising a front part and a back part with respect to the direction of rotation;

controlling the forward movement of a first roll along said path by resting the first roll against the back part of a first group of said arms;

stopping the first roll in the cradle in an angular position where a second group of arms is positioned upstream of the cradle to prevent a subsequent roll from entering the cradle;

moving a second roll forward along said path to rest the second roll against the back part of the second group of arms;

performing a closing operation for closing the tail end of the first roll; and rotating the assembly so as to eject the first roll from the cradle pushing with the front part of the arms of the second group and to move forward the second roll resting against the back part of the arms of the second group to stop it in the cradle.

17. The method according to claim 16, wherein the operation for closing the tail end of the first roll comprises at least one opening and positioning operation of the tail end.

18. The method according to claim 17, comprising applying glue.

19. The method according to claim 18, wherein the glue is applied to the first roll when it is in the cradle, or during or after its ejection from the cradle.

20. The method according to claim 16, in which the rolls are fed along the feeding path rolling due to gravity.

* * * * *